US008359673B2

(12) United States Patent
Fukasawa

(10) Patent No.: US 8,359,673 B2
(45) Date of Patent: Jan. 29, 2013

(54) SWIMMING GOGGLE

(75) Inventor: Shunji Fukasawa, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 745 days.

(21) Appl. No.: 12/292,582

(22) Filed: Nov. 21, 2008

(65) Prior Publication Data

US 2009/0133184 A1 May 28, 2009

(30) Foreign Application Priority Data

Nov. 22, 2007 (JP) ..... 2007-303404

(51) Int. Cl.
*A61F 9/02* (2006.01)

(52) U.S. Cl. ..... 2/448; 2/15; 2/426; 2/428; 2/438; 2/440; 2/442; 2/445; 2/450

(58) Field of Classification Search ..... 2/428, 445, 2/452, 430, 439, 440, 446, 451, 453, 426, 2/427, 429, 447, 443, 444, 454, 448
See application file for complete search history.

(56) References Cited

U.S. PATENT DOCUMENTS 5,515,551 A * 5/1996 Yashiro ..... 2/428
5,734,995 A * 4/1998 Chiang ..... 2/428
5,894,606 A * 4/1999 Chiang ..... 2/440
5,956,778 A * 9/1999 Godoy ..... 2/428
6,115,849 A * 9/2000 Meyerrose ..... 2/452
6,317,897 B1 * 11/2001 Chiang ..... 2/428
6,349,421 B2 * 2/2002 Fukasawa et al. ..... 2/428
D456,439 S * 4/2002 Chiang ..... D16/303
6,446,272 B1 * 9/2002 Lee ..... 2/428
7,003,811 B2 * 2/2006 Canavan ..... 2/448
7,024,705 B2 * 4/2006 Chiang ..... 2/445
7,604,346 B2 * 10/2009 Wang ..... 351/43

FOREIGN PATENT DOCUMENTS

JP 6-190081 7/1994
JP 06190081 A * 7/1994

* cited by examiner

*Primary Examiner* — Gary L Welch
*Assistant Examiner* — Khaled Annis
(74) *Attorney, Agent, or Firm* — Clark & Brody

(57) ABSTRACT

A swimming goggle having connector members which are formed by a material which is flexible, elastically deformable and has rigidity as well as hardness higher than those of the head strap where each of the eye cups is formed on its laterally outer portion with a sloped guide depression and a stopper extending in the vertical direction so as to straddle the guide depression, and the connector member has a front end segment adapted to be connected the eye cup and a rear end segment adapted to be connected with the head strap wherein the front end segment is formed with a latching detent adapted to be engaged with the stopper while the rear end segment is formed with an insertion hole through which the head strap is inserted so that the connector member is inserted with its rear end segment ahead into a gap between the guide depression and the stopper until the latching detent is engaged with the stopper to connect the connector member to the eye cup in a detachable manner.

4 Claims, 6 Drawing Sheets

SWIMMING GOGGLE

BACKGROUND OF THE INVENTION

The present invention relates to a swimming goggle.

Swimming goggles having connector members to connect, eye cups with a head strap is known. For example, JP1994-190081A discloses a swimming goggle having connector members connecting eye cups and a head strap, wherein the connector members are made from hard material and soft material.

According to the disclosure of JP1994-190081A, each of the connector members are comprised of a connection region made of a hard material and a belt region made of a soft material. The connection region is formed by a hard material, whereby it is not readily abraded away due to use and the belt region is formed by a soft elastic material, whereby it only allows the connection region to follow any movement of the eye cup so as to remain fitting the wearer's face but also prevents the connector member from being damaged or falling off from the eye cup even if any strong external impact is exerted on the connector member.

However, the known connector member is adapted to be connected to the eye cup by the intermediary of the connecting means in the form of the buckle and, in consequence, the connector member should be unintentionally disconnected from the eye cup when any strong external impact is exerted on the connection region. In addition, the connection region protrudes outward from the belt region and this should disadvantageously generate a turbulent flow around the swimmer and thereby should increase a water stream resistance.

SUMMARY OF THE INVENTION

It is an object of the present invention to provide a swimming goggle improved to achieve a good fit and thereby a comfortable feeling to wear by forming the connector member which is elastic as a whole, and also improved so that the connector member may be elastically deformed in part to be connected with an eye cup and thereby not only to be free from the anxiety that the connector member might readily fall off from the eye cup even when the connector member is pulled forward or rearward in a front-to-rear direction but also to reduce the number of parts.

According to the present invention, there is provided a swimming goggle having a front-to-rear direction and a vertical direction, and comprising a pair of eye cups each including a lens unit and a frame unit extending rearward from a peripheral edge of the lens unit wherein the lens unit and the frame unit are formed integrally, a connecting bridge connecting laterally inner portions of these eye cups, a head strap and connector members adapted to connect the eye cups with the head strap.

The present invention further comprises the connector members being formed by a material which is flexible, elastically deformable and has rigidity as well as hardness higher than those of the head strap where each of the eye cups is formed on its laterally outer portion with a sloped guide depression and a stopper extending in the vertical direction so as to straddle the guide depression, and the connector member has a front end segment adapted to be connected with the eye cup and a rear end segment adapted to be connected with the head strap wherein the front end segment is formed with a latching detent adapted to be engaged with the stopper while the rear end segment is formed with an insertion hole through which the head strap is inserted so that the connector member is inserted with its rear end segment ahead into a gap between the guide depression and the stopper until the latching detent is engaged with the stopper to be capable of connecting the connector member to the eye cup in a detachable manner.

The present invention further includes preferred embodiments as follow:

(1) A region of the rear end segment in which the insertion hole is formed has the largest width dimension as measured in the vertical direction and the largest width dimension is larger than a width dimension of the guide depression as measured in the vertical direction, and the region in which the insertion hole is formed is elastically deformed as the rear end segment is inserted into the gap defined between the guide depression and the stopper so that the width dimension of the region as measured in the vertical direction is made smaller than the width dimension of the guide depression as measured in the vertical direction to be capable of passing the rear end segment through between the guide depression and the stopper.

(2) The insertion hole is formed with one or more protrusions extending from an inner peripheral wall into the insertion hole.

With the swimming goggle according to the present invention, the connector member made of a soft elastic material may be inserted with its rear end segment ahead into the gap defined between the sloped guide depression and the stopper which is extending in the vertical direction so as to straddle the guide depression both formed on the laterally outer portion of the eye cup until the latching detent formed in the front end segment of the connector member is engaged with the stopper to connect the connector member and the eye cup with each other. Such unique construction ensures that the connector member fits to the wearer's face and eliminates the anxiety that the connector member might be unintentionally disengaged from the eye cup even if any strong external impact is exerted on the connector member.

According to one embodiment of the invention, the rear end segment is elastically deformed and thereby the width dimension thereof as measured in the vertical direction is made smaller than the width dimension as measured in the vertical direction of the guide depression so that the rear end segment can be inserted into the gap defined between the guide depression and the stopper. With such unique construction, it is not apprehended that the connector member might fall off from the eye cup even if the connector member is disengaged from the eye cup during use of the goggle.

According to another embodiment of the invention, the insertion hole formed in the rear end segment of the connector member is formed with a pair of protrusions extending from its inner peripheral wall into the insertion hole. With such unique construction, a movement of the head strap forward is restricted and there is no anxiety that the head strap might be partially turn around within the insertion hole and twisted.

BRIEF DESCTIPTION OF THE DRAWINGS

FIG. 1 is a perspective view showing a swimming goggle according to the present invention as put on by the wearer;

FIG. 2A: a front view of a connector member, FIG. 2B: a plan view of the connector member as viewed from above and FIG. 2C: a rear view of the connector member;

FIG. 3A and FIG. 3B diagrams illustrating procedures in which the connector member is connected to the eye cup;

FIG. 4A and FIG. 4B diagrams illustrating procedures in which the connector member is connected to the eye cup;

DETAILED DESCRIPTION OF THE PREFERRED EMBODIMENTS

Details of a swimming goggle according to the present invention will be more fully understood from the description given hereunder with reference to the accompanying drawings.

Figure 1:
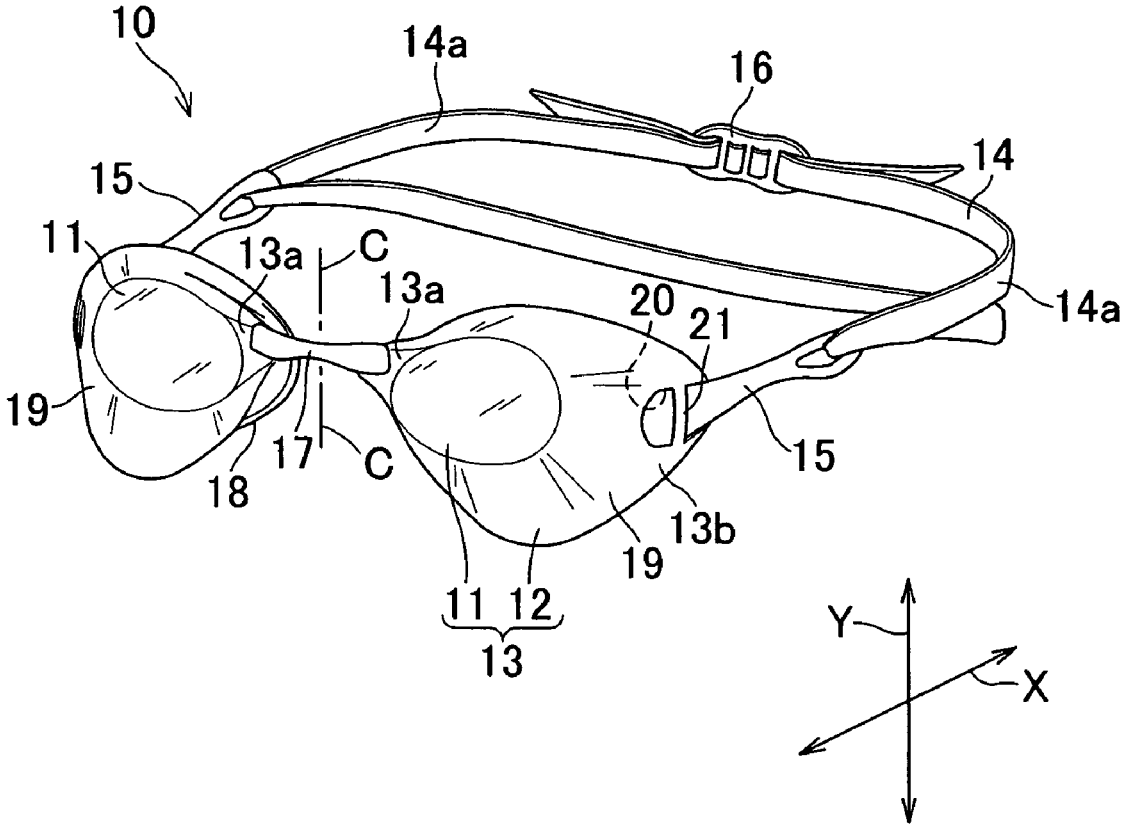

FIG. 1 is a perspective view showing a swimming goggle 10 as put on by the wearer. Referring to FIG. 1, the goggle 10 has a front-to-rear direction X and a vertical direction Y. The line C-C is a center line bisecting a length of a connecting bridge 17 and the goggle 10 is symmetric about the center line C-C. The term "inner" used herein should be understood to be based on a direction toward the center line C-C and the term "outer" used herein should be understood to be the opposite direction to the "inner" direction.

The swimming goggle 10 comprises a pair of eye cups 13 having lens members 11 and frame members 12 integrated with the respective lens members 11, a head strap 14, a pair of connector members 15 extending rearward from laterally outer portions 13*b* of the respective eye cups 13 and a connecting bridge 17. The respective eye cups 13 have respective inner portions 13*a* connected with each other by the intermediary of the connecting bridge 17. The respective eye cups 13 have respective laterally outer portions 13*b* connected to the head strap 14 by the intermediary of the respective connector members 15. The frame members 12 extend rearward from full peripheral edges of the respective lens members 11 and comprise annular inner peripheral walls 18 adapted to be held in water-tight contact around the wearer's eyes and outer peripheral walls 19 each shaped to convex downward. Outer portions of the respective outer peripheral walls 19, i.e., the laterally outer portions 13*b* of the eye cups 13 are formed with sloping guide depressions 20 (See FIG. 5) which have inward depth and latched portions 21 extending in the vertical direction Y so as to straddle the respective guide depressions 20. Though not illustrated, it is possible without departing from the scope of the invention to provide the inner peripheral wall 18 along a peripheral edge thereof with a flange which may be, in turn, detachably provided with a face pad.

Each of the eye cups 13 may be formed from a hard plastic material such as polycarbonate, the head strap 14 may be formed from a relatively soft rubber, plastic (particularly polyurethane) or the like each having a rubber elasticity, each of the connector members 15 may be formed from a plastic material (particularly polyurethane), rubber or the like which is flexible, elastically deformable and has rigidity or stiffness higher than that of the head strap 14, and the connecting bridge 17 may be formed from a plastic material, rubber or the like which is flexible but has a rigidity or stiffness as high as the connector member 15.

Figure 2A:
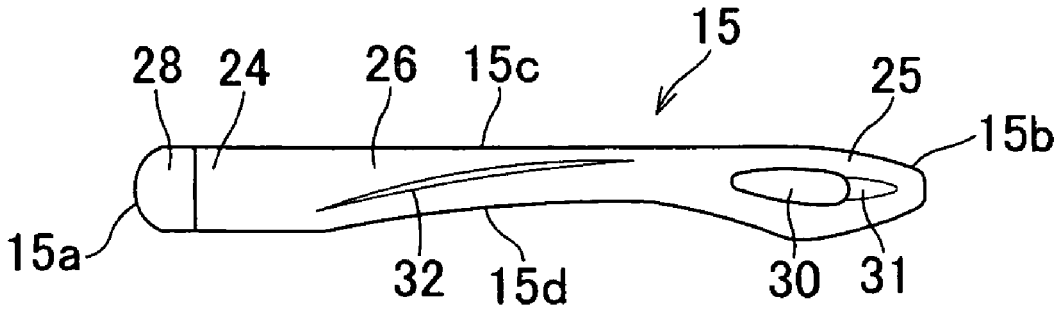
Figure 2B:
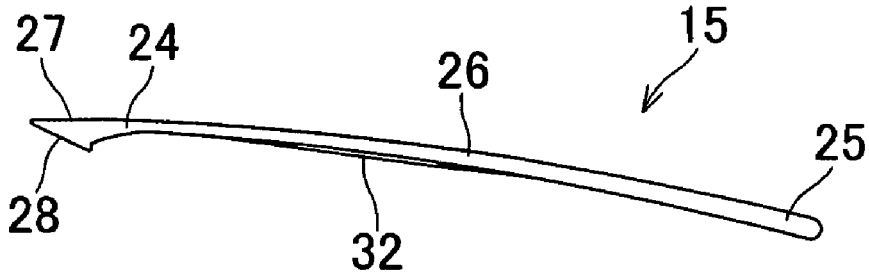
Figure 2C:
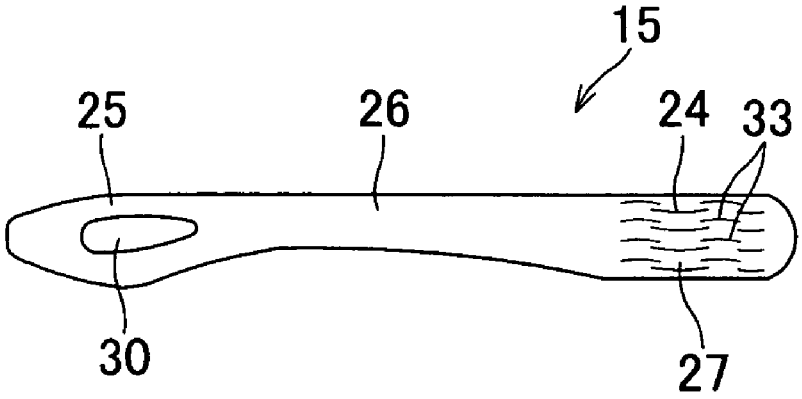

FIG. 2A is a front view of a connector member 15 and FIG. 2B is a plan view of the connector member 15 as viewed from above and FIG. 2C is a rear view of the connector member 15.

As will be apparent from FIG. 2A to FIG. 2C, the connector member 15 is contoured by a circular arc front edge 15*a*, a tapered rear edge 15*b*, a rectilinearly extending upper side edge 15*c* and a lower side edge 15*d* curved inward so as to define an elongate belt-like shape as a whole. The connector member 15 comprises a front end segment 24 adapted to be connected to the eye cup 13, a rear end segment 25 adapted to be connected to the head strap 14 and a middle segment 26 extending between these front and rear end segments 24, 25 in the front-to-rear direction X. The front end segment 24 has a contact surface 27 adapted to come in contact with the sloped guide depression 20 of the eye cup 13 and a latching detent 28 projecting outward from a distal end of the contact surface 27 adapted to come in engagement with a stopper 21 of the eye cup 13 when the front end segment 24 is engaged with the eye cup 13. The rear end segment 25 is formed with an insertion hole 30 through which the head strap 14 is inserted and on the outer surface of the rear end segment 25 with a substantially U- or V-shaped depression 31 extending behind the insertion hole 30. The rear end segment 25 is configured so as to have the maximum width dimension in the vertical direction Y in a region including the insertion hole 30. The middle segment 26 is formed on its outer surface with a single rib 32 extending in the front-to-rear direction X and the front end segment 24 is formed on its contact surface 27 with grains or grooves 33 in various sized wave-patterns.

FIG. 3A and 3B, and FIG. 4A and 4B are diagrams illustrating procedures in which the connector members 15 are connected to the respective eye cups 13.

Figure 3A:
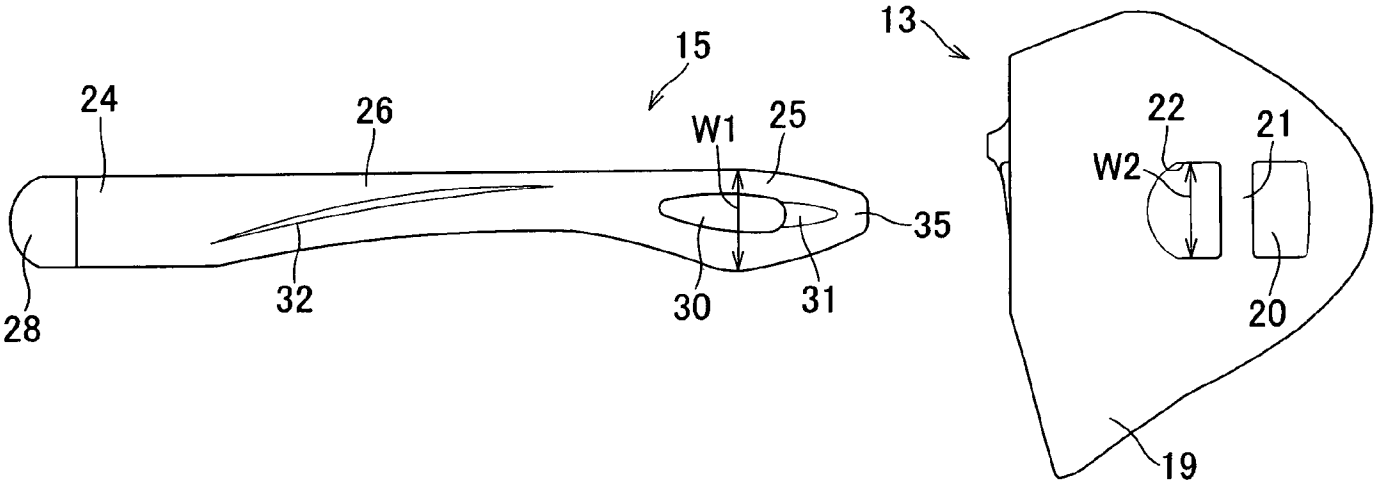
Figure 3B:
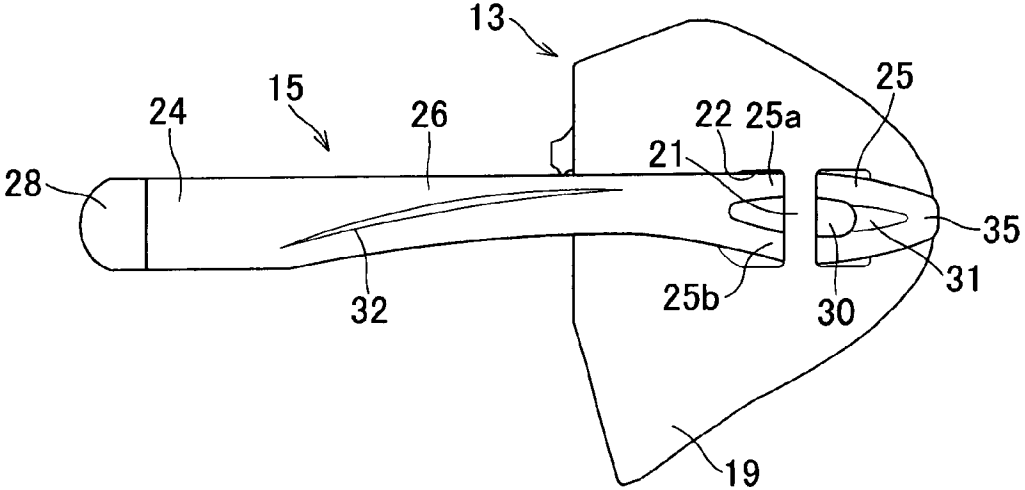

To connect the connector member 15 to the eye cup 13, the connector member 15 is kept in a horizontal posture as seen in FIG. 3A, then the distal end 35 of the rear end segment 25 is guided into a gap defined between the sloped guide depression 20 and the stopper 21 of the eye cup 13 and the rear end segment 25 is pulled rearward as seen in FIG. 3B so as to pass under the stopper 21. For such procedure, the rear end segment 25 preferably has a width dimension W1 in the vertical direction Y as measured in its region including the insertion hole 30 larger than a width dimension W2 of the guide depression 20 in the vertical direction Y. This is for the reason that, with such dimensioning of W1>W2, when the user is wearing the goggle 10 even if the engagement between latching detent 28 and the stopper 21 which will be described in detail below is disengaged due to an extraneous impact or the like, the rear end segment 25 is caught by the inner peripheral wall 22 of the guide depression 20 and thereby the connector member 15 is reliably prevented from unintentionally falling off from the eye cup 13. If the width dimension W1 is smaller than the width dimension W2, on the contrary, when the engagement between the latching detent 28 and stopper 21 is disengaged, the rear end segment 25 will slip forward from the guide depression 20 without being caught by the inner peripheral wall 22 of the guide depression 20 and, in consequence, the connector member 15 may fall off from the eye cup 13.

Setting the width dimension W1 of the rear end segment 25 in the vertical direction Y to be larger than the width dimension W2 of the guide depression 20 in the vertical direction Y causes the rear end segment 25 to be caught by the inner peripheral wall 22 of the guide depression 20 when the distal end 35 of the rear end segment 25 is pulled rearward after the distal end 35 has been inserted into the gap between the guide depression 20 and the stopper 21 in the course of assembling the goggle 10. It will be thus impossible for the rear end segment 25 to pass through the guide depression 20 if nothing is done. To overcome this, after the distal end 35 of the rear end segment 25 has been inserted into the guide depression 20, the distal end 35 of the rear end segment 25 may be pulled rearward with the upper and lower side edges 25*a*, 25*b* being forced to slide in close contact with the inner peripheral wall 22 of the guide depression 20. The upper and lower side edges 25*a*, 25*b* of the rear end segment 25 are forcibly put in contact with the inner peripheral wall 22 and thereby elastically deformed and bent toward the insertion hole 30. As a result, the width dimension W1 is sufficiently reduced to ensure that the upper and lower side edges 25*a*, 25*b* of the rear end segment 25 are no more caught by the inner peripheral wall 22 of the guide depression 20 and the rear end segment 25 can pass rearward through the guide depression 20. In the course of such procedures by close contracting the upper and lower side edges 25*a* and 25*b*, the U- or V-shaped depression 31 having a thickness smaller than those of the upper and lower side edges 25*a*, 25*b* are elastically deformed and folded inward before the upper and lower side edges 25*a*, 25*b* will be elastically deformed, facilitating the upper and lower side edges 25*a*, 25*b* to be elastically deformed.

It is also possible to facilitate elastic deformation of the upper and lower side edges 25*a*, 25*b* by pulling the rear end segment 25 rearward while the rear end segment 25 is squeezed between user's fingers from above and below.

Figure 4A:
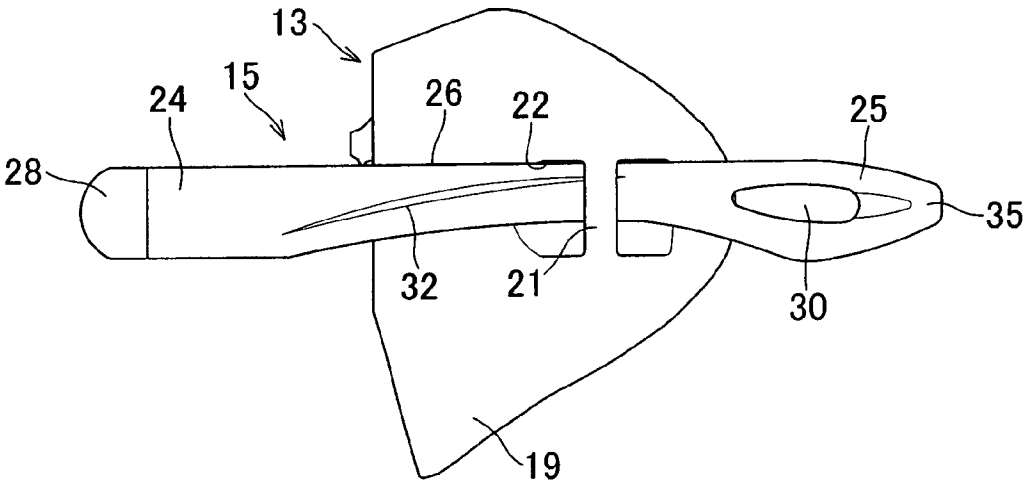
Figure 4B:
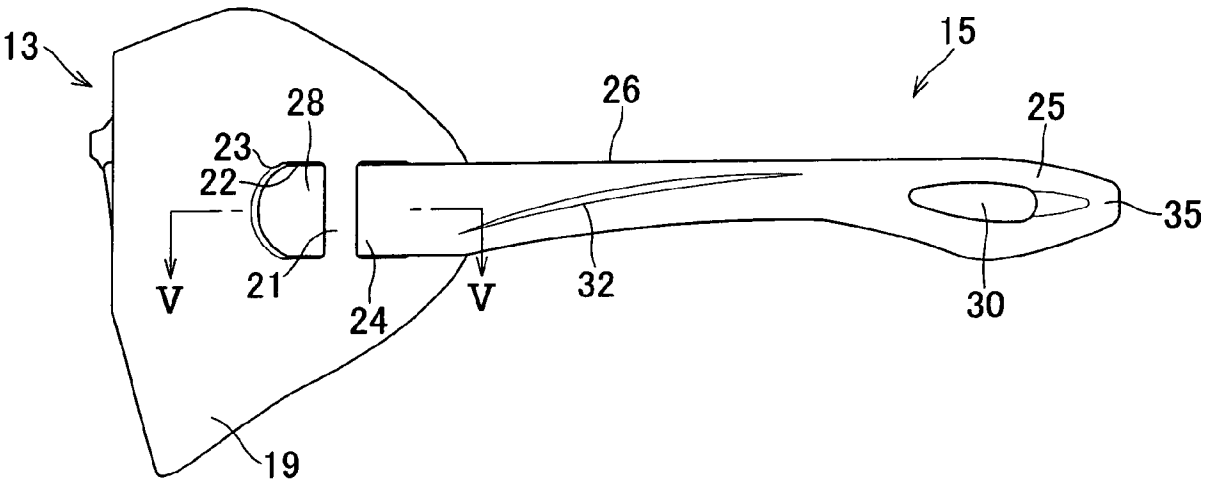

After the rear end segment 25 has been passed under the stopper 21, the connector member 15 may be pulled further rearward so that the middle segment 26 also may be passed under the stopper 21 as illustrated by FIG. 4A and 4B until the contact surface 27 defined on the inner side of the front end segment 24 comes in contact with the sloped surface 23 of the guide depression 20. From this state, the front end segment 24 is pulled rearward until the latching detent 28 comes in engagement with the stopper 21. In this way, the connector member 15 may be connected with the eye cup 13.

Figure 5:
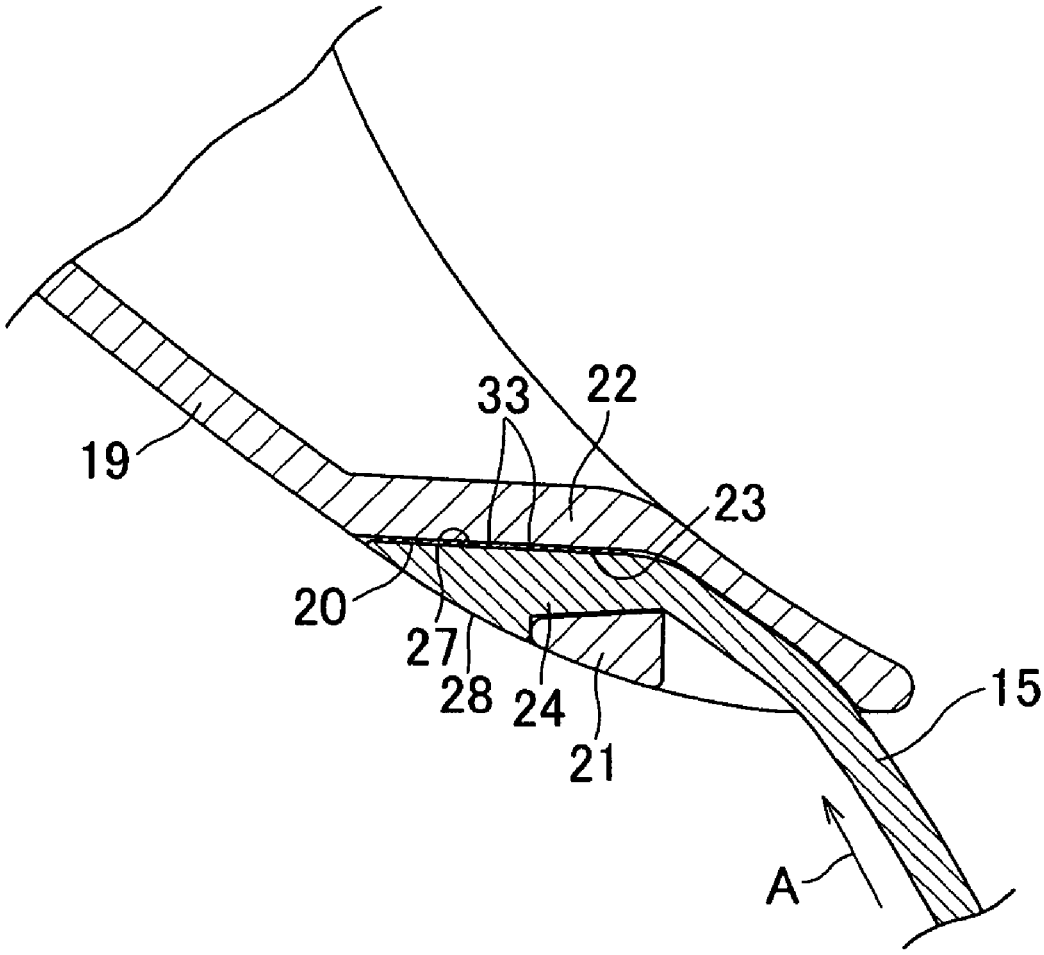
FIG. 5 is a sectional view taken along the line V-V in FIG. 4B.

FIG. 5 is a sectional view taken along the line V-V in FIG. 4B.

When it is desired to disengage the connector member 15 from the eye cup 13 from the state in which the latching detent 28 is engaged with the stopper 21, even if the connector member 15 is subjected to a force directed to disengage the latching detent 28 from the stopper 21 (to the direction of arrow A in FIG. 5), it will be difficult to transmit such force to the front end segment 24. This is for the reason that the middle segment 26 of the connector member 15 being in no contact with the sloped surface 23 of the guide depression will be elastically deformed and consequently bent. Furthermore, close contact between the entire contact surface 27 of the front end segment 24 and the entire sloped surface 23 of the guide depression 20 will excessively increase a frictional force and a correspondingly large force will be required to disengage these two surfaces from each other. To solve this problem, the contact surface 27 of the front end segment 24 may be formed with the grains or grooves 33 and thereby the contact area between the contact surface 27 and the sloped surface 23 may be reduced. In this way, the frictional force may be sufficiently reduced to facilitate the connector member 15 to be disassembled.

As will be apparent from FIG. 5, when the latching detent 28 is engaged with stopper 21, none of steps appears between the outer peripheral wall 19 of the eye cup 13 and the latching detent 28 as well as between the latching detent 28 and the stopper 21 and, in addition, the laterally outer portion 13*b* is streamlined. Consequentially, there is no apprehension that any turbulent flow might be generated and water stream resistance might be increased.

Figure 6:
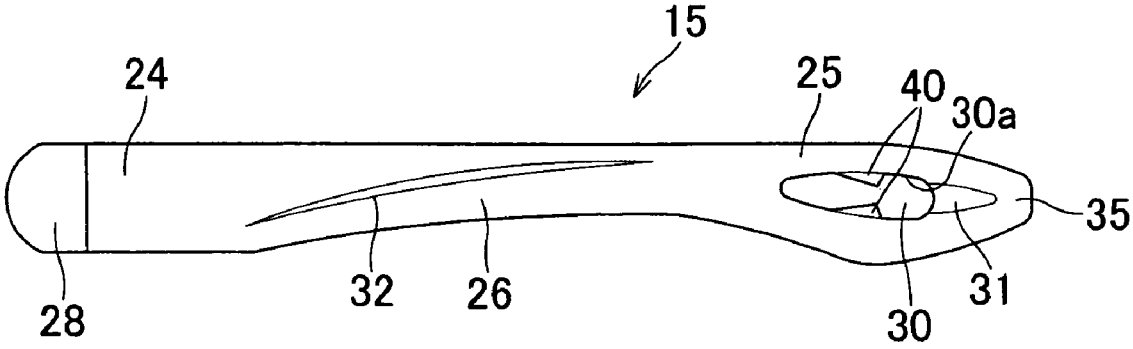
FIG. 6 is a front view of a connector member according to an alternative embodiment.

FIG. 6 is a plan view of the connector members 15 according to an alternative embodiment.

The connector member 15 according to this alternative embodiment is basically similar to the embodiment illustrated by FIGS. 1 through 5 and the construction common to these two embodiments will not be repetitively described. This embodiment is distinguished from the previously described embodiment in that the inner peripheral wall 30*a* of the insertion hole 30 is formed with a pair of protrusions 40 extending into the insertion hole 30. These protrusions 40 impose restrictions forward movement of the head strap 14 within the insertion hole 30 and thereby serve to fix the position of the head strap and to eliminate a possibility that the head strap 14 might partially turn around and twist. It should be understood here that it is not essential to provide a pair of the protrusions 40 and at least one protrusion may extend from the inner peripheral wall 30*a* into the insertion hole 30 from above or below to prevent the head strap from twisting.

The connector member 15 has appropriate flexibility and is able to follow a movement of the eye cup 13 so that it may smoothly fit to the wearer's face without an anxiety that it might be readily disengaged from the eye cut 13 even if it is exposed to an external impact. To this end, the connector member 15 preferably has a degree of hardness in a range of 80 to 100°. If the degree of hardness exceeds 100°, it will be impossible for the connector member 15 to follow movement of the eye cup as has been described above, so that a position adjustment of the eye cup 13 will be difficult, and, if any external impact is exerted, it will be impossible for the connector member 15 to absorb the external impact and, in consequence, it is apprehended that the connector member 15 might fall off from the eye cup 13. If the degree of hardness of the connector member 15 is lower than 80°, the degree of hardness of the connector member 15 will become excessively lower than that of the eye cup 13. As a result, it is apprehended that the front end segment 24 might be readily disengaged from the connector member 15 as it is pulled rearward together with the head strap 14 and the connector member 15 itself might be broken under such pulling force.

The head strap 14 preferably has a degree of hardness in a range of 40° to 60°. If the degree of hardness thereof is lower than 40°, the head strap will not fit to the wearer's head and the segment of the head strap 14 held within the insertion hole 30 of the connector member 15 might be cut off by a rear end of the inner peripheral wall 30*a* of the insertion hole 30 at the time of putting on the goggle.

The middle segment 26 of the connector member 15 is formed with at least one rib 32 extending in the front-to-rear direction X. The presence of the rib 32 ensures that the middle segment 26 of the connector member 15 is prevented from being cut off even if the connector member 15 is made of a relatively less rigid material and is strongly pulled in the front-to-rear direction X. The rib 32 has also a decorative effect.

The entire discloses of Japanese Patent Application No. 2007-303404 filed on Nov. 15, 2007 including specification, drawings and abstract are herein incorporated by reference in its entirety.

What is claimed is:

1. A swimming goggle having a front-to-rear direction and a vertical direction, and comprising a pair of eye cups each including a lens unit and a frame unit extending rearward from a peripheral edge of said lens unit wherein said lens unit and said frame unit are formed integrally, a connecting bridge connecting respective laterally inner portions of these eye cups, a head strap and connector members adapted to connect respective said eye cups with said head strap, said swimming goggle further comprises:

said connector members being formed by material which is flexible, elastically deformable and has rigidity as well as hardness higher than those of said head strap where each of said eye cups is formed on its laterally outer portion with a sloped guide depression and a stopper extending in said vertical direction so as to straddle said guide depression, and said connector member having an elongate belt-like shape, a front end segment adapted to be connected with said eye cup, a rear end segment adapted to be connected with said head strap, and a middle segment extending between said front and rear end segments in the front-to-rear direction, wherein said front end segment is formed with a latching detent adapted to be engaged with said stopper while said rear end segment is formed with an insertion hole through which said head strap is inserted, whereby said connector member is inserted with its rear end segment ahead into a gap defined between said guide depression and said stopper, and said latching detent is engaged with said stopper to connect said connector member to said eye cup in a detachable manner, where a region of said rear end segment in which said insertion hole is formed has the largest width dimension as measured in said vertical direction and said largest width dimension is larger than a width dimension of said guide depression as measured in said vertical direction, and said region in which said insertion hole is formed is elastically deformed as said rear end segment is inserted into said gap defined between said guide depression and said stopper, and the width dimension of said region as measured in said vertical direction is made smaller than the width dimension of said guide depression as measured in said vertical direction to be capable of passing said rear end segment through between said guide depression and said stopper; and a width dimension as measured in said vertical direction of said middle segment is smaller than width dimensions of the front and rear end segments as measured in said vertical direction.

2. The goggle according to claim 1, where said insertion hole is formed with one or more protrusions extending from an inner peripheral wall of said insertion hole into said insertion hole.

3. The goggle according to claim 1, where no steps appear between an outer peripheral wall of said eye cup and said latching detent as well as between said latching detent and the said stopper in a state that said latching detent is engaged with said stopper.

4. The goggle according to claim 1, where said middle segment is formed on its outer surface with a single rib extending in the front-to-rear direction.

* * * * *